US006213552B1

(12) United States Patent
Miotto

(10) Patent No.: US 6,213,552 B1
(45) Date of Patent: Apr. 10, 2001

(54) MULTI-POSITION CHAIR CONTROL MECHANISM FOR SYNCHRONOUSLY ADJUSTING THE SEAT AND BACKREST OF A CHAIR

(75) Inventor: Beniamino Miotto, Roncade (IT)

(73) Assignee: Miotto International Company, Green Bay, WI (US)

( * ) Notice: Subject to any disclaimer, the term of this patent is extended or adjusted under 35 U.S.C. 154(b) by 0 days.

(21) Appl. No.: 09/197,039

(22) Filed: Nov. 20, 1998

(Under 37 CFR 1.47)

(51) Int. Cl.[7] ..... A47C 1/024; A47C 3/026

(52) U.S. Cl. ..... 297/300.5; 297/300.7; 297/301.6; 297/301.4; 297/302.4; 297/302.6; 297/344.19

(58) Field of Search ..... 297/300.5, 344.19, 297/300.4, 300.7, 301.6, 302.6, 302.4, 301.4

(56) References Cited

U.S. PATENT DOCUMENTS

| | | |
|---|---|---|
| 637,715 | 11/1899 | DeFontes . |
| 2,321,385 | 6/1943 | Herold . |
| 2,471,024 | 5/1949 | Cramer . |
| 2,712,346 | 7/1955 | Sprinkle . |
| 2,827,951 | 3/1958 | Herider et al. . |
| 3,730,019 | 5/1973 | Ballard . |
| 4,337,978 | 7/1982 | Kazaoka et al. . |

(List continued on next page.)

FOREIGN PATENT DOCUMENTS

| | | |
|---|---|---|
| 0052832 | 11/1981 | (EP) . |
| 0126839 | 12/1984 | (EP) . |
| 0233974 | 9/1987 | (EP) . |
| 0489961 | 6/1992 | (EP) . |
| 2760335 | 3/1998 | (FR) . |
| VE96001 U | 1/1996 | (IT) . |
| VE96016 U | 5/1996 | (IT) . |
| WO 94/28769 | 12/1994 | (WO) . |
| WO 97/24955 | 7/1997 | (WO) . |
| WO 98/09553 | 3/1998 | (WO) . |

*Primary Examiner*—Peter M. Cuomo
*Assistant Examiner*—Rodney B. White
(74) *Attorney, Agent, or Firm*—Andrus, Sceales, Starke & Sawall, LLP

(57) ABSTRACT

A seat adjustment mechanism for a chair includes a first handle which controls the height of the seat above a surface supporting the chair. A second handle allows the user to selectively lock the seat at a user selected angle relative to the supporting surface. As the seat is tilted into a desired position, the seat adjustment mechanism provides limited horizontal and vertical movement of the seat to maintain the chair in an ergonomically correct position. The mechanism includes a housing or enclosure adapted for connection to a pedestal, and a seat bracket for mounting to the underside of the seat. An intermediate bracket is pivotably mounted to the lower enclosure. One end of the seat mounting bracket is pivotably connected to an end of the intermediate bracket, and the other end of the seat bracket is interconnected with the lower enclosure via a link arrangement. A selectively operable locking mechanism is interconnected between the lower enclosure and the intermediate bracket, for selectively preventing and allowing angular movement of the intermediate bracket relative to the lower enclosure, to lock the seat in a predetermined angular position or to enable the seat to pivot relative to the pedestal.

26 Claims, 5 Drawing Sheets

U.S. PATENT DOCUMENTS

| | | | | |
|---|---|---|---|---|
| 4,384,741 | | 5/1983 | Flum et al. . | |
| 4,761,033 | * | 8/1988 | Lanuzzi et al. | 297/300.5 X |
| 4,773,704 | | 9/1988 | Engels . | |
| 4,834,454 | | 5/1989 | Dicks . | |
| 4,840,426 | * | 6/1989 | Vogtherr et al. | 297/300.5 |
| 4,943,115 | | 7/1990 | Stucki . | |
| 5,080,434 | | 1/1992 | Locher . | |
| 5,150,948 | * | 9/1992 | Volkle | 297/300.5 |
| 5,195,801 | * | 3/1993 | Franck et al. | 297/300.5 |
| 5,282,670 | | 2/1994 | Karsten et al. . | |
| 5,294,178 | | 3/1994 | Bogle et al. . | |
| 5,318,345 | * | 6/1994 | Olson | 297/300.5 |
| 5,348,371 | | 9/1994 | Miotto . | |
| 5,573,303 | | 11/1996 | Doerner . | |
| 5,577,807 | | 11/1996 | Hodge et al. . | |
| 5,658,045 | | 8/1997 | Van Koolwijk et al. . | |
| 5,664,834 | * | 9/1997 | Hsu | 297/300.5 X |
| 5,685,607 | | 11/1997 | Hirschmann . | |
| 5,975,634 | * | 11/1999 | Knoblock et al. | 297/300.5 X |
| 6,120,096 | | 9/2000 | Miotto | 297/301.4 |

* cited by examiner

FIG. 1
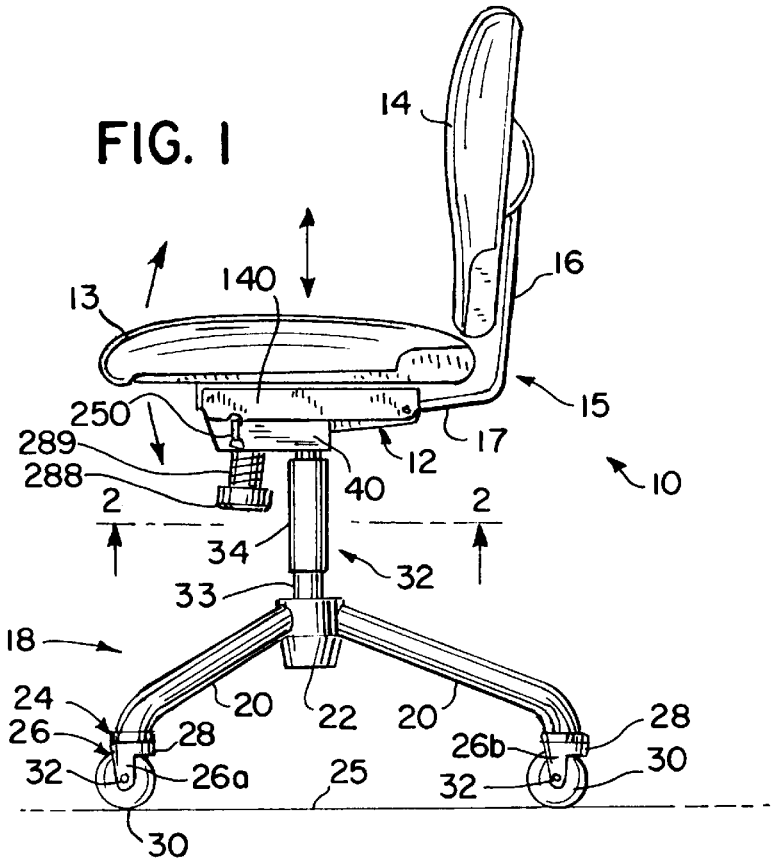
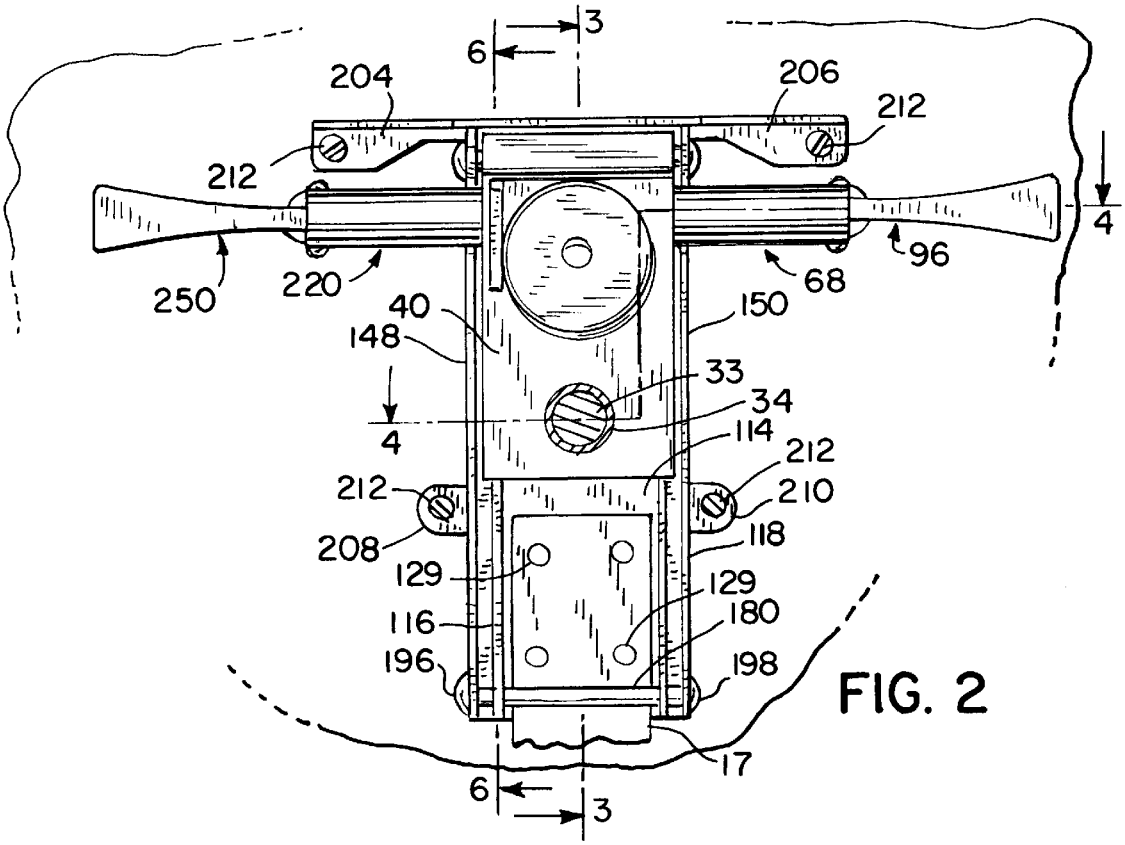
FIG. 2

MULTI-POSITION CHAIR CONTROL MECHANISM FOR SYNCHRONOUSLY ADJUSTING THE SEAT AND BACKREST OF A CHAIR

BACKGROUND AND SUMMARY OF THE INVENTION

The present invention relates to chairs, and in particular, to an adjustment mechanism for controlling the height and the tilt of a seat for a chair, as well as the angle of the chair backrest relative to the seat.

It is well known in the art to incorporate mechanisms into a chair to permit the tilting of the chair back and/or seat in order to enhance the comfort of a user. In order to control the positioning of the seat and backrest, complicated mechanisms are often required. These mechanisms are actuated by a plurality of handles, buttons, levers and the like in order to control the various movements of the seat. The plurality of handles not only detract from the aesthetic properties of the chair, but also render adjustment of the seat and backrest difficult for a user who is unfamiliar with the operation and function of each actuator.

Further, prior art adjustment mechanisms tend to be complicated in that they require many parts. For example, in Miotto, U.S. Pat. No. 5,348,371, a chair is provided which incorporates a mechanical device to effectuate the synchronous movement of the seat and backrest. In order to selectively lock the seat in a user selected stationary position, a plurality of friction discs are provided. By rotation of a handle under the seat of the chair, the discs are compressed so as to prevent movement of the seat by friction. The large number of parts involved in this type of locking arrangement adds to the overall cost and complexity of the mechanism.

Therefore, it is a primary object and feature of the present invention to provide a chair control mechanism which is simple to operate and inexpensive to manufacture.

It is a further object and feature of the present invention to provide a chair control mechanism for a chair wherein a user may adjust the vertical height of the seat with one lever and the seat and backrest angle with another lever.

It is a further object and feature of the present invention to provide a chair control mechanism wherein the angle of the seat with respect to the supporting surface of the chair, and the angle of the backrest relative to the seat, may be easily manipulated and selectively locked into position with a single handle.

In accordance with the present invention, a device for adjusting the position of a seat of a chair is adapted for use with a pedestal including a central vertical column. The central column includes a gas piston assembly for varying the length thereof. An enclosure is connectable about an upper end of the central column. An actuator element is pivotably mounted to the enclosure and movable between a first actuating position wherein the actuator element actuates the gas piston assembly thereby allowing the length of the central column to be adjusted to a user selected length, and a second non-actuating position wherein the central column is maintained by the gas piston assembly at the user selected length. A handle extends from the enclosure and is pivotably movable between a first position wherein the handle urges the actuator element into the first, actuating position, and a second position. Means are provided for urging the actuator element toward the non-actuating position.

It is also contemplated to provide a plunger housing extending laterally from the enclosure and a plunger element slidably supported therein. The plunger element has a first end engaging the actuator element and a second end engaging the handle wherein movement of the handle between the first and second positions causes the plunger element to slide axially within the plunger housing. The handle is pivotably mounted to the plunger housing such that a first end of the handle extends into the plunger housing and a second end of the handle extends outwardly therefrom.

The device also includes a seat bracket interconnected to the seat and a link element pivotably mounted to the seat bracket and to the enclosure, for interconnecting the seat bracket to the enclosure. The link element allows for limited horizontal and vertical movement of the seat bracket with respect to the enclosure. An intermediate bracket is pivotably mounted to the enclosure and to the seat bracket at a location spaced from the link element, and pivotable movement of the seat bracket with respect to the enclosure results in a corresponding pivotable movement of the intermediate bracket with respect to the enclosure over a predetermined range. The intermediate bracket may be locked at a user selected position for selectively fixing the position of the seat bracket to the enclosure, and thereby the position at the seat relative to the pedestal. A back support member is connected to the intermediate bracket, such that movement of the intermediate bracket results in adjustment in the angular position of the back relative to the seat. In this manner, the angle of the back is adjusted synchronously with adjustment of the seat angle.

In accordance with another aspect of the invention, a seat adjustment mechanism is provided for controlling movement of a seat of a chair. The seat adjustment mechanism includes a bracket assembly operatively connected to the seat for allowing horizontal and vertical movement of the seat over a predetermined range. A locking element is provided for locking the seat at a user selected position within the predetermined range.

In accordance with yet another aspect of the invention, a device is provided for interconnecting a seat to a central support. The device includes an enclosure operatively connected to the support. A seat connection bracket is operatively connected to the seat and a link element interconnects the enclosure and the seat connection bracket. An intermediate bracket is pivotably mounted to the enclosure and to the seat connection bracket wherein a predetermined pivotable movement of the intermediate bracket with respect to the enclosure translates into a corresponding predetermined movement of the seat connection bracket with respect to the enclosure. A locking member is provided for maintaining the intermediate bracket in one of a plurality of predetermined positions with respect to the enclosure.

Various other features, objects and advantages of the invention will be made apparent from the following description taken together with the drawings.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is a side elevational view of a chair incorporating the chair control mechanism of the present invention;

FIG. 2 is a cross-sectional view taken along line 2—2 of FIG. 1 showing a bottom plan view of the mechanism of the present invention;

DETAILED DESCRIPTION OF THE INVENTION

Figure 3:
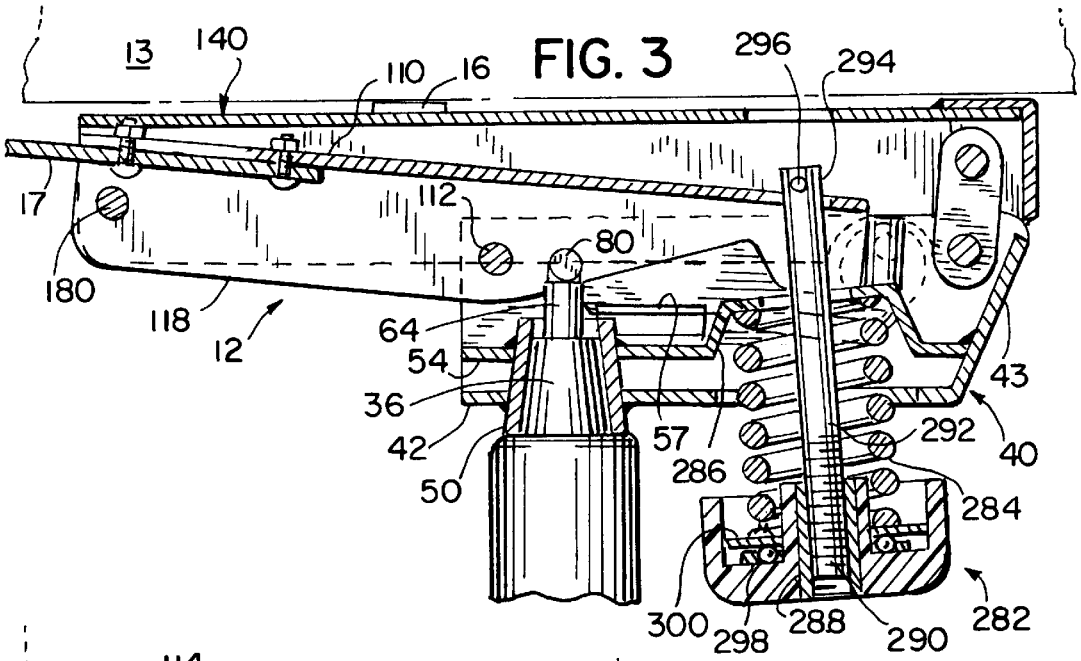
FIG. 3 is a cross-sectional view taken along line 3—3 of FIG. 2.

Referring to FIG. 1, a chair 10 is provided incorporating a chair control mechanism generally designated by the reference 12. Chair 10 includes a seat 13 and a backrest 14 mounted to a back support member 15, commonly known as a "J-bar", which includes a back mounting portion 16 and seat mounting portion 17 interconnected with chair control mechanism 12.

Pedestal 18 includes a plurality of legs 20 diverging from a central hub 22. Each leg 20 terminates at a caster 24 to facilitate the rolling of chair 10 across a supporting surface 25. Each caster 24 includes a forked wheel supporting bracket 26 depending from a leg mounting portion 28. Each bracket 26 defines a wheel receiving cavity for receiving wheel 30 between forks 26*a* and 26*b*. Each wheel 30 is interconnected to its corresponding bracket 26 by an axle 32 extending between each fork 26*a* and 26*b* of the bracket 26 so as to allow for rotation of wheel 30 about the axle.

Figure 4:
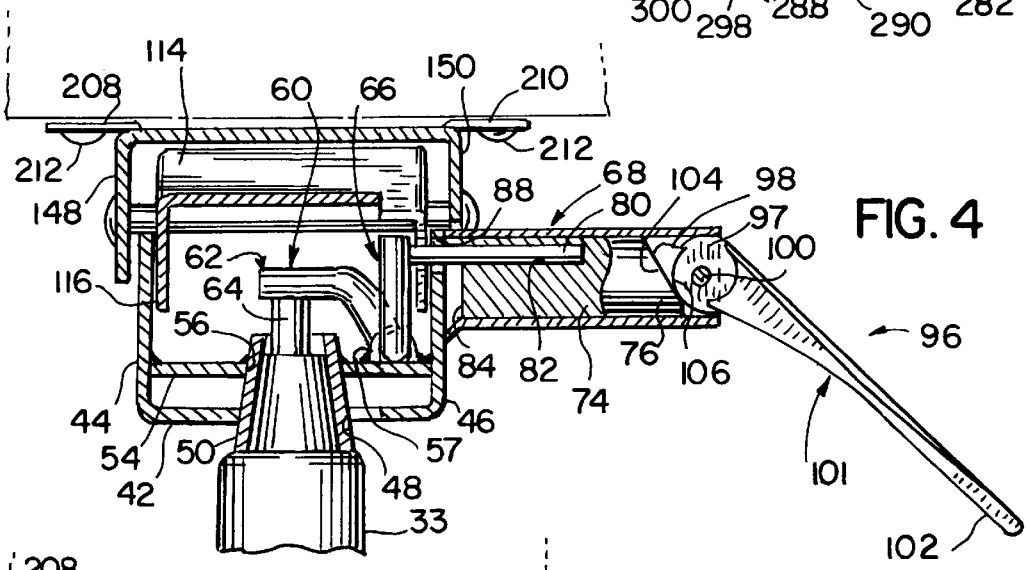
FIG. 4 is a cross-sectional view taken along line 4—4 of FIG. 2 showing a seat height control assembly of the chair control mechanism in a non-actuating position.
Figure 5:
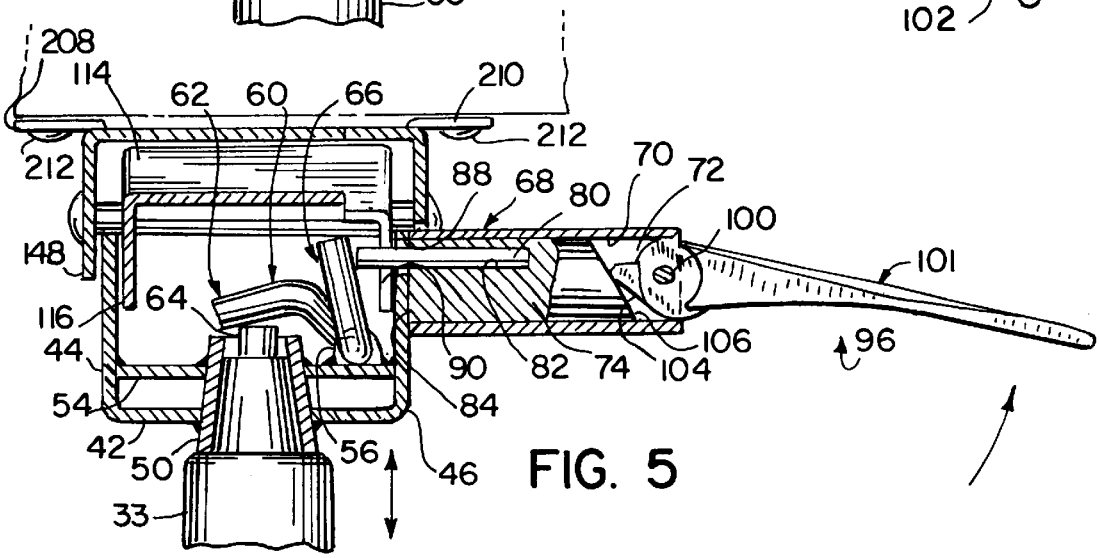
FIG. 5 is a cross-sectional view, similar to FIG. 4, showing the seat height control assembly in an actuating position.

A cylindrical housing 32 extends vertically from hub 22 to support chair control mechanism 12. Cylindrical housing 32 includes a first support member 33 which is mounted to hub 22, and a second support member 34 is telescopically mounted to first support member 33, in accordance with conventional technology. A gas piston assembly is interconnected with first and second support members 33, 34, respectively, in a manner as is known. As best seen in FIGS. 3–5, the gas piston assembly 32 includes a conical mounting portion 36 which is mounted to chair control mechanism 12 for controlling the vertical position of seat 13, as hereinafter described.

Chair control mechanism 12 includes a fixed position support member in the form of a first lower housing or enclosure 40. Lower enclosure 40 includes a generally flat lower plate 42 having first 44 and second 46 walls extending vertically from opposite sides thereof. A front wall 43 interconnects first and second walls 44 and 46, respectively, and lower plate 42. Lower plate 42 includes a centrally positioned aperture 48 therein for receiving a tapered sleeve 50, which is mounted to lower plate 42 such as by welding. Conical mounting portion 36 of the gas piston assembly engages the internal wall of tapered sleeve 50, to rigidly and stationarily mount lower enclosure 40 to cylindrical housing assembly 32.

Lower enclosure 40 further includes an upper plate 54 also having an opening 56 therein for receiving sleeve 50 therethrough, and sleeve 50 is secured to upper plate 54 such as by welding. Upper plate 54 is vertically spaced from lower plate 42 and is interconnected to first and second walls 44 and 46, respectively, and front wall 43. Upper plate 54 includes a channel member 57 (FIGS. 3–5) for pivotably supporting a gas piston actuating element 60. Gas piston actuating element 60 includes a horizontal first end 62 which abuts a gas piston stem 64, and a vertical second end 66.

A generally cylindrical plunger housing 68 extends laterally from vertical wall 46 of lower enclosure 40. Plunger housing 68 includes a generally cylindrical inner surface 70 which defines a plunger receipt cavity 72. A generally cylindrical slider element 74 is positioned within plunger cavity 72 and includes an outer cylindrical surface 76 which forms a slidable interface with inner surface 70 of plunger housing 68.

A plunger element 80 is supported partially within a cavity 82 in slider element 74 and projects from an inner end 84 thereof. Plunger element 80 extends through an opening 88 in vertical wall 46 of lower enclosure 40 and into contact with vertical end 66 of gas piston actuating element 60.

A handle 96 is pivotally mounted via a pivot pin 100 to plunger housing 68. Handle 96 includes a spherical head 97 and a nose-like inner end 98 which extends into the plunger receipt cavity 72 defined by plunger housing 68. Inner end 98 of handle 96 terminates at an angled slider engaging surface 104 which abuts an outer end 106 of slider element 74 having a complementary engagement surface. A portion of head 97 is flattened and coplanar with slider engagement surface 104. Handle 96 also includes an outer end 101 extending outwardly from head 97, terminating in a finger engagement area 102 for engagement by a user.

In operation, handle 96 is pivotable about pivot pin 100 between a first, non-actuating position, FIG. 4, and a second, actuating position, FIG. 5. Movement of handle 96 to its actuating position of FIG. 5 engages end 98 with the angled engagement surface defined by outer end 106 of slider element 74, to move slider element 74 axially to the left in FIG. 5 so as to cause plunger element 80 to urge actuator element 60 counterclockwise. As actuator element 60 is urged counterclockwise, end 62 thereof engages and depresses gas piston stem 64, FIG. 5, thereby allowing vertical adjustment of second support member 34 relative to first support member 33, to position seat 13 at a user selected height. In order to maintain the user selected height, handle 96 is pivoted about pivot pin 100 to the first, non-actuating position, FIG. 4, thereby allowing gas piston stem 64 to return to its at-rest position, which functions to move actuator element 60 clockwise about channel member 57 from its FIG. 5 position to its FIG. 4 position.

Figure 6:
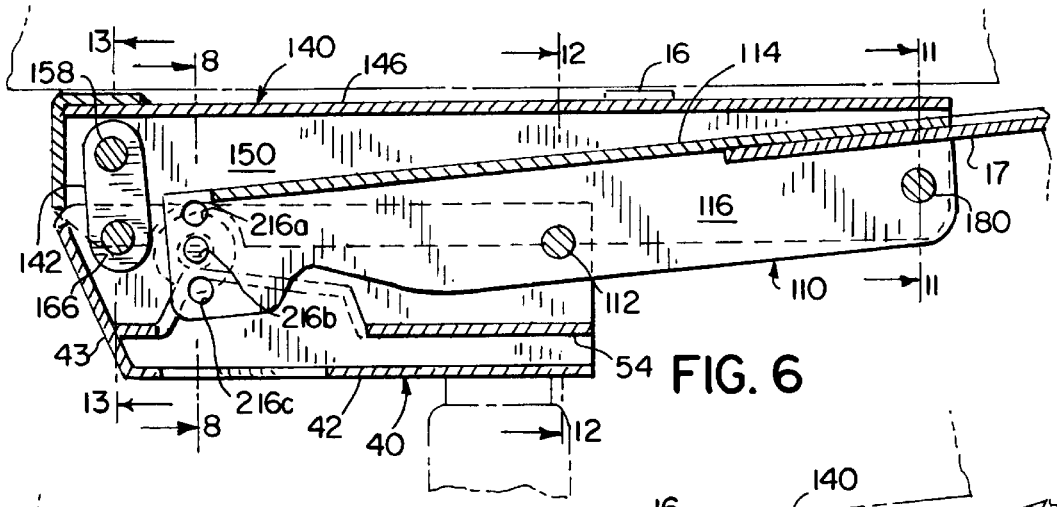
FIG. 6 is a cross-sectional view taken along line 6—6 of FIG. 2.
Figure 7:
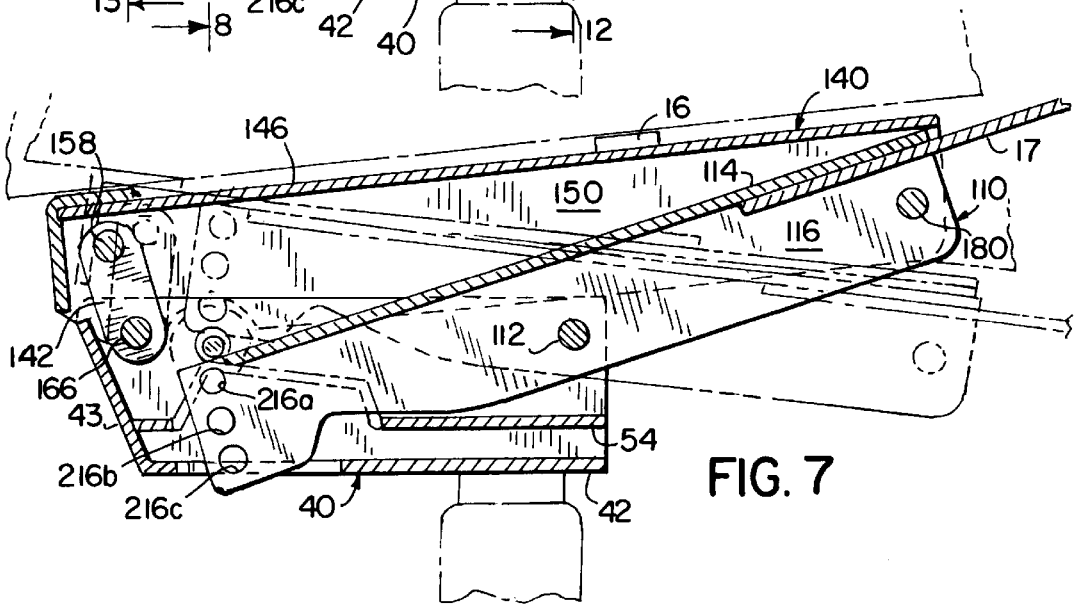
FIG. 7 is a cross-sectional view, similar to FIG. 6, showing multiple positions of the chair control mechanism in phantom.
Figure 12:
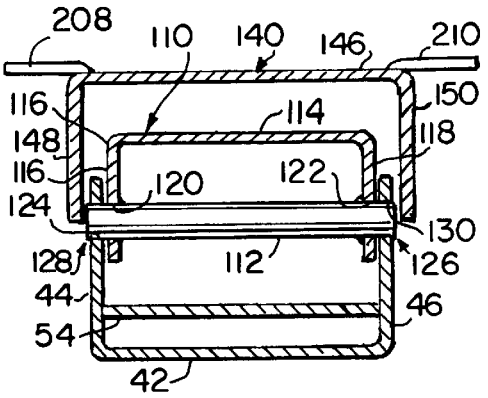
FIG. 12 is a cross-sectional view taken along line 12—12 of FIG. 6.

Referring to FIGS. 6–7 and 12, a generally U-shaped intermediate bracket 110 is pivotably mounted to lower enclosure 40 by a centrally located pivot pin 112. Intermediate bracket 110 includes a generally flat base portion 114 and walls 116 and 118 depending from opposite sides thereof. Walls 116 and 118 include corresponding axially aligned openings 120 and 122, respectively. Similarly, vertical walls 44 and 46 of lower enclosure 40 include openings 124 and 126, respectively, in axial alignment with openings 120 and 122 in walls 116 and 118, respectively.

As shown in FIGS. 2, 3, 6 and 7, seat mounting portion 17 of back support member 15 is mounted to intermediate bracket base portion 114 by means of a series of bolts 129.

As best seen in FIG. 12, end 128 of pivot pin 112 extends through opening 120 in wall 116 and opening 124 in wall 44, while end 130 extends through opening 122 in wall 118 and through opening 126 in wall 46. Pivot pin 112 is fixed to walls 116, 118 adjacent openings 120, 122, such as by welding. As best seen in FIG. 7, intermediate bracket 110 may pivot with respect to lower enclosure 40 about pivot pin 112 throughout a range of angular positions between a forwardly tilted position shown in solid lines and a rearwardly tilted position shown in phantom.

Figure 13:
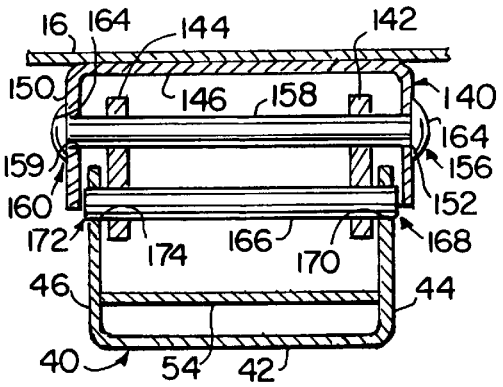
FIG. 13 is a cross-sectional view taken along line 13—13 of FIG. 6.

Lower enclosure 40 is also interconnected to an upper seat bracket 140 by forwardly located first and second links 142 and 144, respectively, FIG. 13. Upper seat bracket 140 is generally U-shaped and includes a generally flat upper plate 146 having first, 148 and second 150 walls depending therefrom. Walls 148 and 150 include corresponding openings 152 and 154, respectively, which are in axial alignment with each other. A first end 156 of a pivot pin 158 extends through opening 152 in wall 148 and a second end 160 of pivot pin 158 extends through opening 154 in wall 150. Heads 162 and 164 are placed on corresponding ends 156 and 160, respectively, of pivot pin 158 in order to maintain pivot pin 158 in position. Pivot pin 158 passes through an opening in the upper end of each of links 142, 144.

Links 142 and 144 interconnect pivot pin 158 with a pivot pin 166 mounted to lower enclosure 40. Pivot pin 166 includes a first end 168 which extends through an opening 170 in vertical wall 44 of enclosure 40, and a second end 172 which extends through an opening 174 in vertical wall 46 of enclosure 40. Walls 150, 152 of upper seat bracket 140 overlap the ends of pivot pin 166, to prevent lateral movement of pivot pin 166 and maintain pin 166 in positive relative to upper seat bracket 140 and enclosure 40. Pivot pin 166 passes through an opening formed in the lower end of each of links 142, 144.

Figure 11:
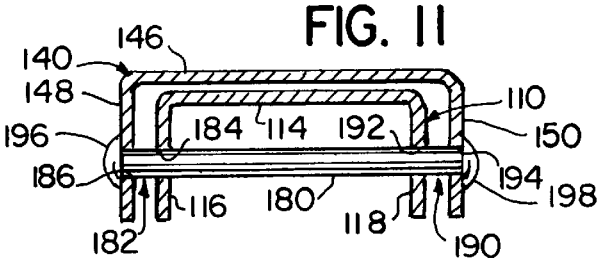
FIG. 11 is a cross-sectional view taken along line 11—11 of FIG. 6.

Referring to FIG. 11, intermediate bracket 110 and upper seat bracket 140 are interconnected by a rearwardly located pivot pin 180. Pivot pin 180 includes a first end 182 which extends through an opening 184 in wall 116 of intermediate bracket 110 and through an opening 186 in wall 148 of upper seat bracket 140. A second end 190 of pivot pin 180 extends through an opening 192 in wall 118 of intermediate bracket 110 and through an opening 194 in wall 150 of upper seat bracket 140. Heads 196 and 198 are mounted to corresponding ends 182 and 190, respectively, of pivot pin 180 to maintain pivot pin 180 in position.

As best seen in FIG. 2, upper seat bracket 140 includes first 204 and second 206 forward flanges extending laterally from walls 148 and 150, respectively, of upper seat bracket 140. In addition, rearward flanges 208 and 210 extend laterally from walls 148 and 150, respectively, of upper seat bracket 140. Flanges 204, 206, 208 and 210 include a corresponding aperture therethrough in order to interconnect upper seat bracket 140 to the underside of seat 13, such as a seat board or other rigid member, by means of screws 212 or the like.

Referring to FIG. 7, the tilting or pivoting movement of seat 13 is controlled by links 142 and 144 which interconnect upper seat bracket 140 with lower enclosure 40, and by pivot pin 180 which interconnects upper seat bracket 140 with intermediate bracket 110. When seat 13 is tilted forwardly and downwardly, from right to left in FIG. 7 as shown in solid lines, the forward end of upper seat bracket 140 pivots counterclockwise about pivot pin 166 through links 142, 144, while intermediate bracket 110 pivots counterclockwise about pivot pin 112. When seat 13 is tilted rearwardly and upwardly, from right to left in FIG. 7 as shown in phantom, upper seat bracket 140 pivots clockwise about pivot pin 166 through links 142, 144, while intermediate bracket 110 pivots clockwise about pivot pin 112. As described, movement of seat 13 translates into a corresponding movement of intermediate bracket 110 about pivot pin 112 over a predetermined range. In addition, movement of seat 13 translates into a corresponding movement of upper seat bracket 140 about pivot pin 166 through links 142, 144 relative to lower enclosure 40 and about pivot pin 180 relative to intermediate bracket 110. As shown in FIG. 7, seat bracket 140 moves in a front-rear direction during movement of seat 13 by pivoting action between links 142, 144 and upper and lower pivot pins 158, 166, respectively. That is, clockwise movement of intermediate bracket 110 about pivot pin 112, caused by the user reclining in seat 13 to exert a downward force on the rear end of intermediate bracket 110 through seat bracket 140 and pivot pin 180, causes the forward end of seat bracket 140 to pivot clockwise about pivot pin 166 through links 142, 144. Simultaneously, seat bracket 140 pivots counterclockwise relative to links 142, 144 about pivot pin 158. Conversely, counterclockwise movement of intermediate bracket 110 about pivot pin 112, caused by the user leaning forwardly in seat 13 to exert an upward force on the rear end of intermediate bracket 110 through seat bracket 140 and pivot pin 180, causes the forward end of seat bracket 140 to pivot counterclockwise about pivot pin 166 through links 142, 144. Simultaneously, seat bracket 140 pivots clockwise relative to links 142, 144 about pivot pin 158.

During angular movement of seat 13, which results in pivoting movement of intermediate bracket 110 about pivot pin 112, the angle of back 14 is simultaneously and synchronously adjusted along with the angle of seat 13 by the pivoting movement of intermediate bracket 110. As can be seen in FIG. 7, back mounting member 15 pivots about pivot pin 180 during pivoting movement of intermediate bracket 10 about pivot pin 112. When intermediate bracket 110 is in its rearwardmost tilted position shown in phantom in FIG. 7, seat mounting portion 17 of back support member 15 is substantially parallel with the underside of seat 13 and upper wall 146 of seat bracket 140. When seat 13 is pivoted to its forwardmost position as shown in solid lines in FIG. 7, seat mounting portion 17 of back support member 15 is pivoted forwardly relative to upper wall 146 of seat bracket 140, to move backrest 14 forwardly relative to seat 13.

Figure 8:
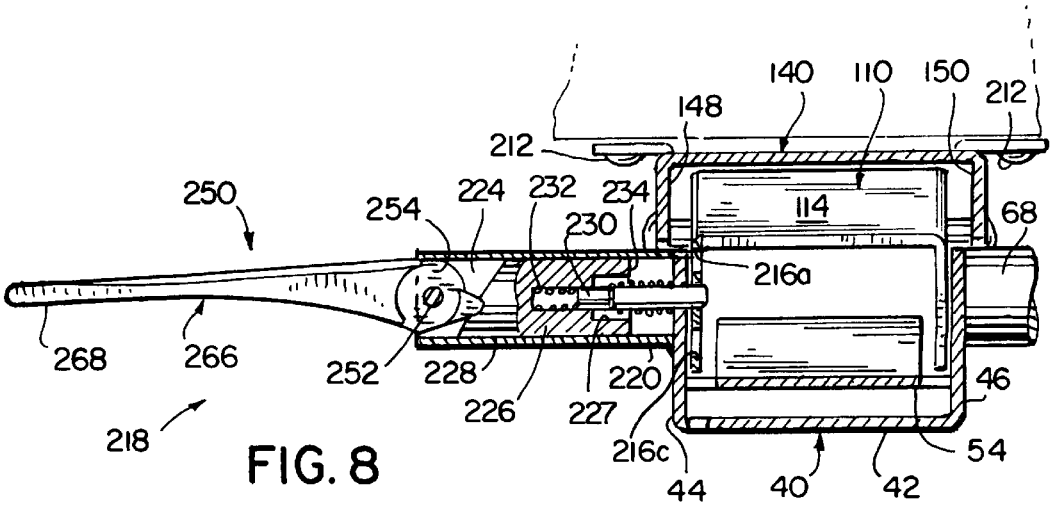
FIG. 8 is a cross-sectional view taken along line 8—8 of FIG. 6 showing a seat angle locking assembly of the chair control mechanism.
Figure 9:
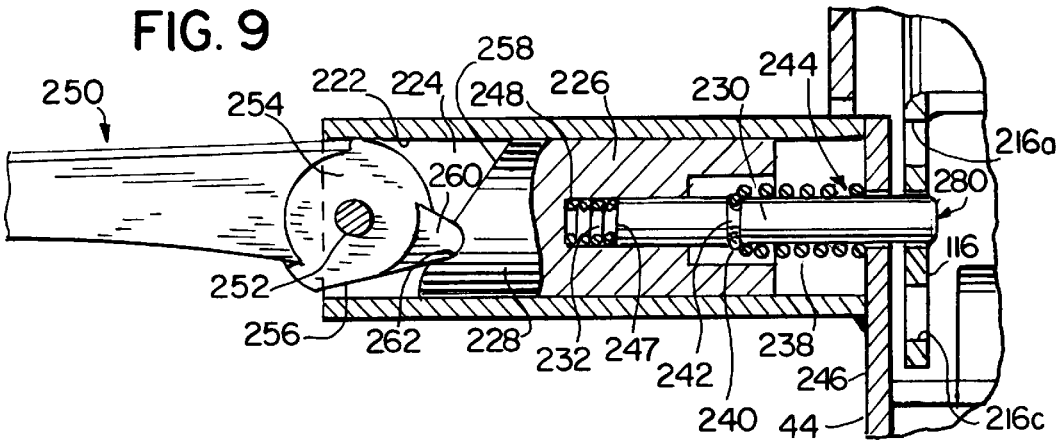
FIG. 9 is an enlarged, cross-sectional view showing a portion of the seat angle locking assembly of FIG. 8 in a locked position.

As best seen in FIGS. 6–10, in order to maintain intermediate bracket 110 in a user selected position, a locking assembly 218 is provided. Locking assembly 218 includes a generally cylindrical lock member housing 220 extending laterally from vertical wall 44 of lower enclosure 40 in a direction opposite that of plunger housing 68. Lock member housing 220 includes a generally cylindrical inner surface 222 which defines a lock member receipt cavity 224. A generally cylindrical slider element 226 is positioned within lock member receipt cavity 224 and includes an outer cylindrical surface 228 which forms a slidable interface with inner surface 222 of lock member housing 220. A locking pin or element 230 is supported within a passage 232 in slider element 226 and projects from an inner end 234 thereof. A recess 227 is provided in inner end 234 of slider element 226 in order to accommodate a spring 238 positioned about locking element 230. As shown in FIG. 9, spring 238 has a first end 240 embedded in a groove 242 in locking element 230 and a second end 244 abutting the outer surface 246 of lower enclosure wall 44 so as to bias locking element 230, and hence slider element 226, away from wall 44. A spring 247 bears between the inner end of passage 232, shown at 248, and the inner end of locking element 230. Spring 247 functions to bias locking element 230 outwardly relative to slider element 226 and toward wall 44.

A handle 250 is pivotally mounted via a pivot pin 252 to lock member housing 220. Handle 250 is constructed similarly to handle 96, and includes a spherical head which extends into the lock member receipt cavity 224. Head 254 of handle 250 defines an angled slider engaging surface 256 which abuts an outer end 258 of slider element 226 having a complementary engagement surface. Head 254 of handle 256 also includes a nose-like inner end or locking tip 260 dimensioned for receipt in a corresponding recess 262 in the outer end 258 of slider element 226. Handle 250 also includes an outer end 266 extending outwardly from head 254, terminating in a finger engagement area 268 for engagement by a user.

Figure 10:
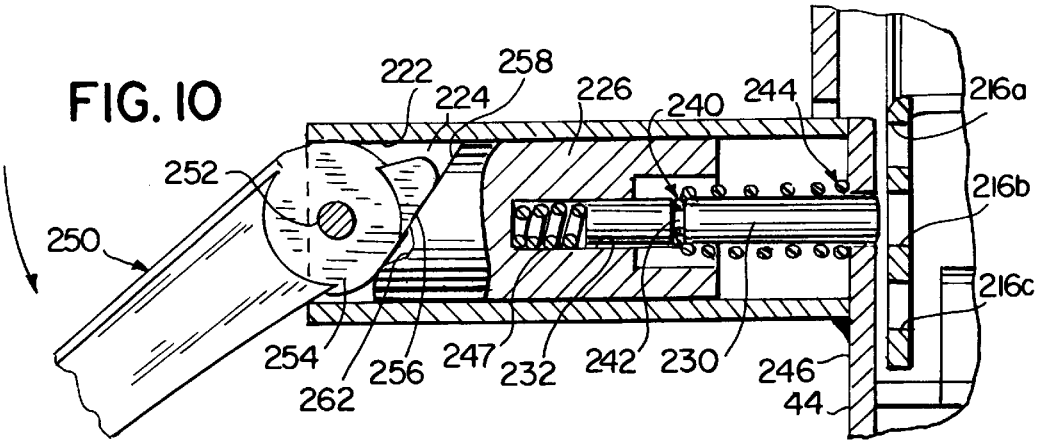
FIG. 10 is a cross-sectional view, similar to FIG. 9, showing the seat angle locking assembly in an unlocked position.

In operation, handle 250 is pivotable about pivot pin 252 between a first, non-actuating position, FIG. 10, and a second, actuating position, FIG. 9. In the non-actuating position, spring 238 overcomes the bias of spring 247 and forces slider element 226 to the left in FIG. 10 so as to disengage locking element 230 from intermediate bracket 110. In order to lock intermediate bracket 110 in a predetermined position, handle 250 is pivoted clockwise such that slider element 226 is urged to the right in FIG. 9. As slider element 226 is urged to the right in FIG. 9, springs 247 and 238 are compressed and an inner end 280 of locking element 230 extends into one of a series of openings 216*a*–216*c* formed in wall 116 of intermediate bracket 110. Each opening 216*a*–216*c* in wall 116 of intermediate bracket 110 corresponds to a predetermined angular position of intermediate bracket 110 related to lower enclosure 40. By inserting locking element 230 into a corresponding opening 216*a*–216*c* in wall 116 of intermediate bracket 110, intermediate bracket 110 cannot pivot with, respect to lower enclosure 40 on pivot pin 112. This, in turn, prevents movement of upper seat bracket 140 and, consequently, of seat 13.

In order to maintain locking element 230 in its selected opening 216*a*–216*c* in wall 116 of intermediate bracket 110, locking tip 260 of handle 250 is positioned within corresponding recess 262 in slider element 226. With locking tip 260 of handle 250 received within recess 262 in slider element 226, locking element 230 is retained in the selected one of openings 216*a*–216*c* in intermediate bracket 110 against the bias of spring 238. As best seen in FIG. 7, intermediate bracket 110 may also be locked in position by extending inner end 280 of locking element 230 over intermediate bracket side wall 116 such that locking member 230 engages base portion 114 of intermediate bracket 110 to lock seat 13 in its forwardmost tilted position. In addition, locking element 230 may be positioned to engage the lower end of intermediate bracket side wall 116 to lock seat 13 in its rearwardmost tilted position and to fix the position of backrest 14. In this manner, intermediate bracket 116 with its three openings 216*a*–216*c*, in combination with locking member 230, provides five locking positions for intermediate bracket 110, and thereby for seat 13.

With handle 250 in the non-actuating position, intermediate bracket 110 is free to pivot on pivot pin 112. This allows seat 13 to be moved freely relative to pedestal 18 throughout its entire range of motion, as illustrated in FIG. 7.

Referring to FIG. 3, a spring assembly 282 is provided for urging intermediate bracket 110 toward a home position wherein seat 13 assumes a predetermined angle, which may be generally horizontal. Spring assembly 282 includes a conventional coil spring 284 which defines an upper end in engagement with upper plate 54 of lower enclosure 40 at a recess 286 formed therein. Coil spring 284 extends downwardly from recess 286, and defines a lower end which is received in a tension adjustment cap 288. It is contemplated to enclose spring 284 within a bellows 289, FIG. 1, so as to prevent user contact with spring 284 and to enhance the overall aesthetic appearance of mechanism 12.

Tension adjustment cap 288 is threaded onto a first end 290 of a rod 292. A second end 294 of rod 292 extends through an opening formed in base portion 114 of intermediate bracket 110. A pin 296 interconnects end 294 of rod 292 to base portion 114 of intermediate bracket 110.

In operation, the rearward tilting or reclining of seat 13 of chair 12 causes counterclockwise rotation of intermediate bracket 110 about pivot pin 112. This movement causes tension adjustment cap 288 to be drawn upwardly through rod 292 toward lower enclosure 40, which is resisted by the compression force of spring 284 which bears against tension adjustment cap 288. As the forces causing the counterclockwise rotation of intermediate bracket 110 about pivot pin 112 are relaxed, spring 284 urges intermediate bracket 110 to its home position, FIG. 3.

A thrust bearing 298 is mounted between a spring washer 300, which engages the lower end of coil spring 284, and the inner surface of tension adjustment cap 288 in order to facilitate rotation of cap 288. A user may adjust the force exerted by spring 284 by rotating the tension adjustment cap 288 relative to rod 292. This provides an adjustment in the amount of force required to tilt seat 13, and also in the home position of intermediate bracket 110.

Figure 14:
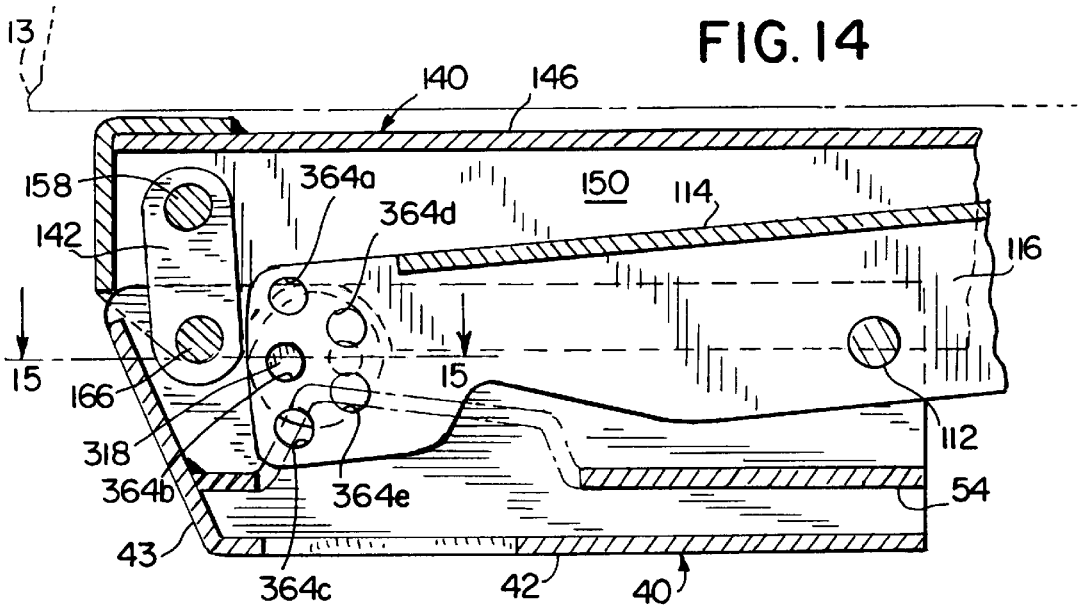
FIG. 14 is an enlarged, sectional view showing an alternate seat angle locking assembly for the chair control mechanism of the present invention.
Figure 15:
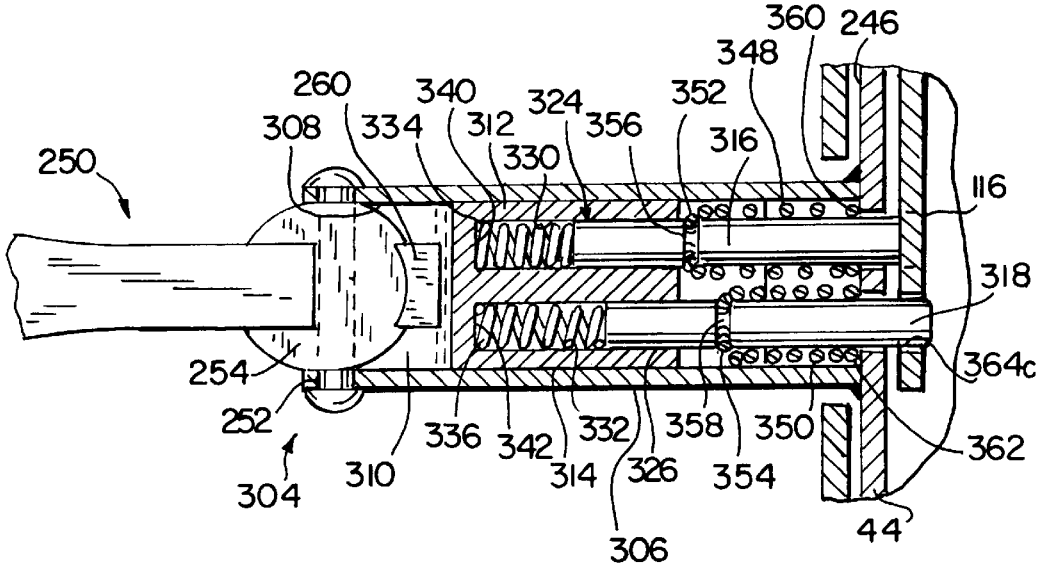
FIG. 15 is a cross-sectional view of the alternate seat angle locking assembly taken along line 15—15 of FIG. 14.

Referring to FIGS. 14 and 15, an alternate locking assembly 304 in accordance with the present invention is shown. With the exception of the locking assembly, the chair disclosed in FIGS. 14–15 is identical to that previously described, and hence, the previous description of the chair 10 will be understood to apply to the chair shown in FIGS. 14–15, with common reference characters being used.

Locking assembly 304 includes a generally cylindrical lock member housing 306 which extends laterally from vertical wall 44 of lower enclosure 40. Lock member housing 306 includes a generally cylindrical inner surface 308 which defines a lock member receipt cavity 310. A generally cylindrical slider element 312 is positioned within lock member receipt cavity 310 and includes an outer cylindrical surface 314 which forms a slidable interface with the inner surface 308 of lock member housing 306.

Locking assembly 304 further includes first 316 and second 318 locking elements supported by slider element 312. Locking elements 316 and 318 have first ends 324 and 326, respectively, received within corresponding passages 330 and 332, respectively, in slider element 312. Coil springs 334 and 336 are positioned within passages 330 and 332, respectively, in slider element 312. As best seen in FIG. 15, coil springs 334 and 336 urge corresponding locking elements 316 and 318, respectively, toward wall 116 of intermediate. bracket 110.

Locking elements 316 and 318 also include corresponding springs 348 and 350, respectively. Springs 348 and 350 define first ends 352 and 354, respectively, embedded in corresponding grooves 356 and 358, respectively, in locking elements 316 aid 318, respectively. Second ends 360 and 362 of springs 348 and 350, respectively, abut the outer surface 246 of wall 44 of lower enclosure 40 so as to bias locking elements 316 and 318, respectively, and thereby slider element 312, away from wall 44.

In the embodiment of FIGS. 14 and 15, a pair of offset, staggered rows of openings are formed in side wall 116 of intermediate bracket 110, in place of openings 216*a*–216*c* (FIGS. 6–8). As shown in FIG. 14, a first row of openings 364*a*, 364*b* and 364*c* is formed in intermediate bracket side wall 116, in alignment with locking element 318. A, second row of openings 364*d*, 364*e* is offset from first row 364*a*–364*c*, in alignment with locking element 316. Openings 364*d*, 364*e* are staggered in location relative to openings 364*a*–364*c*, such that opening 364*d* is located between openings 364*a* and 364*b*, and opening 364*e* is located between openings 364*b* and 364*c*.

In operation, as previously described, handle 250 is pivotable about pivot pin 252 between a first, non-actuating position, and a second, actuating position. In the non-actuating position, springs 348 and 350 bias slider element 312 to the left in FIG. 15, through engagement of locking elements 316, 318 with slider element 312 through springs 334, 336, respectively, so as to disengage corresponding locking elements 316 and 318, respectively, from openings 364*a*–364*e* in intermediate bracket 110. In order to lock intermediate bracket 110 in a predetermined position, handle 250 is pivoted clockwise such that slider element 312 is urged to the right in FIG. 15. As slider element 312 is urged to the right in FIG. 15, the inner end of each locking element 316, 318 is moved toward and into engagement with intermediate bracket side wall 116. If one of locking elements 316, 318 is in alignment with one of openings 364*a*–364*e*, the inner end of the locking element extends into the aligned one of openings 364*a*–364*e* under the influence of the outer spring, such as 334, 336. As shown in FIG. 15, locking element 318 is shown with its inner end extending through opening 364*c*, with the inward biasing force provided by its outer spring 336 functioning to overcome the outward biasing force provided by its inner spring 350. Locking element 316 is shown with its inner end in engagement with intermediate bracket side wall 116 under the influence of the inward bias provided by its outer spring 334, which overcomes the outward bias provided by its inner spring 348.

Each opening 364*a*–364*e* in wall 116 of intermediate bracket 110 corresponds to a predetermined position for intermediate bracket 110 relative to lower enclosure 40. By inserting one of the locking elements 316 and 318 into a corresponding one of openings 364*a*–364*e* in wall 116 of intermediate bracket 110, intermediate bracket 110 cannot pivot with respect to lower enclosure 40 on pivot pin 112. This, in turn, prevents movement of upper seat bracket 140 and, consequently, of seat 13, to thereby lock seat 13 in a desired user-selected position. In addition, as in the prior embodiment, locking element 318 is engageable with either the upper or lower edge of intermediate bracket side wall 116 to maintain intermediate bracket 110 in its forwardmost and rearwardmost tilted positions, respectively. In this manner, intermediate bracket 110 and the five openings 364*a*–364*e* formed in side wall 116 provide seven locking positions for intermediate bracket 110, and thereby for seat 13.

As previously described, with handle 250 in the non-actuating position, intermediate bracket 110 is free to pivot on pivot pin 112. Spring assembly 282 urges intermediate bracket 110 to the home position wherein seat 13 may be oriented generally horizontal.

In either embodiment of the locking assembly, the locking elements, such as 230, 316 and 318, are retained in their locking position within an opening in intermediate bracket side wall 116 when handle 250 is first moved to its non-actuating position of FIG. 10, due to friction exerted on the locking member by lower enclosure wall 44 and intermediate bracket side wall 116. When the user tilts seat 13 so as to relieve this frictional force on the locking member such as 230, 316 and 318, the spring, such as 238, 348 and 350, respectively, functions to draw the respective locking member outwardly from the opening in intermediate bracket side wall 116 within which the respective locking member was received. In the release operation, the user must have his or her body in contact with back 14 in order to tilt seat 13. This avoids the possibility of back 14 hitting the user while releasing locking assembly 218 when sitting on seat 13 and not in contact with back 14, as was the case with prior art mechanisms of this type. This provides an "anti-shock" feature for chair control mechanism 12. In addition, when handle 250 is first moved to its actuating position of FIG. 9, the locking member such as 230, 316 and 318 may not be in exact alignment with one of the openings in intermediate bracket side wall 116, and will thus initially engage the outer surface of intermediate bracket side wall 116. Subsequent forward or rearward tilting movement of seat 13 by the user will cause angular displacement of intermediate bracket 116 as described previously, and movement of one of the openings in intermediate bracket side wall 116 into alignment with the respective locking element 230, 316 and 318 to enable the locking element to pass into the aligned opening.

As can be appreciated, mechanism 12 is relatively simple in its construction and components, and yet provides a wide range of pivoting movement of seat 13 with a large number of user-selectable locking positions for maintaining seat 13 in a desired angular position. Mechanism 12 eliminates the complexity and cost associated with a friction disk-type locking assembly while nonetheless providing a relatively large number of locking positions. In addition, mechanism 12 provides ergonomically advantageous operation by simultaneously translating the seat in a frontward-rearward direction upon pivoting movement of the seat, due to the operation of links 142, 144.

Various modes of carrying out the invention are contemplated as being within the scope of the following claims particularly pointing out and distinctly claiming the subject matter which is regarded as the invention.

I claim:

1. A mechanism for controlling movement of a seat of a chair, comprising:

a bracket assembly adapted to be connected to the seat for allowing angular movement of the seat over a predetermined range, wherein the bracket assembly includes a rigid support element, a seat connection member adapted for connection to the seat, and an intermediate member pivotably mounted to the support element and to the seat connection member wherein movement of the seat translates into a corresponding movement of the intermediate member, and wherein the bracket assembly further includes a horizontal movement arrangement interconnected between the seat connection member and the support element for imparting horizontal movement to the seat connection member upon angular movement of the intermediate member relative to the support element, wherein the intermediate member comprises a bracket including a plurality of apertures, each aperture corresponding to one of a plurality of predetermined positions for the seat in the predetermined range; and a locking arrangement which interacts with the apertures for locking the seat at a user selected position within the predetermined range.

2. The mechanism of claim 1, wherein the support element includes an aperture extending therethrough, wherein the support element aperture is axially alignable with a user selected aperture of the plurality of apertures in the intermediate member.

3. The mechanism of claim 2, wherein the locking arrangement includes at least one pin, wherein the pin is positionable within the support element aperture and the user selected aperture in the intermediate member so as to prevent movement of the intermediate member with respect to the support element.

4. A chair control mechanism for controlling movement of a seat of a chair, comprising:

a rigid support element;

a seat connection member adapted for connection to the seat;

an intermediate member pivotably mounted to the support element for movement about a first pivot axis and pivotably mounted to the seat connection member for movement about a second pivot axis spaced from the first pivot axis; and link structure pivotably connected between the seat connection member and the support element;

wherein the first and second pivot axes cooperate to provide angular adjustment of the seat connection member relative to the support element and wherein the link structure provides simultaneous horizontal movement of the seat connection member relative to the support element.

5. The mechanism of claim 4, further comprising a biasing element disposed between the support element and the intermediate member for biasing the seat toward a predetermined angular position.

6. The mechanism of claim 4, wherein the horizontal movement arrangement comprises at least one link member pivotably mounted to the seat connection member and to the rigid support element for providing front-rear movement of the seat connection member relative to the rigid support element upon pivoting movement of the intermediate member relative to the support element.

7. The mechanism of claim 4, further comprising a seat height adjustment actuator assembly associated with the bracket assembly.

8. The mechanism of claim 7, wherein the seat height adjustment assembly includes a first support member telescopically mounted to a second support member.

9. A mechanism for controlling movement of a seat of a chair, comprising:

a bracket assembly adapted to be connected to the seat, wherein the bracket assembly is constructed and arranged to provide simultaneous angular and horizontal movement of the seat over a predetermined range;

a locking arrangement for locking the seat at a user selected position within the predetermined range;

a seat height adjustment actuator assembly associated with the bracket assembly, wherein the seat height adjustment assembly includes a first support member telescopically mounted to a second support member, an actuator stem operatively connected to one of the support members, and an actuator element pivotably mounted to the bracket assembly and movable between a first actuating position wherein the actuator element actuates the actuator stem to vary the position of the first support member relative to the second support member, and a second non-actuating position wherein the first support member is retained in a fixed position with respect to the second support member.

10. The mechanism of claim 9, further comprising a handle extending from the support element and pivotably movable between a first position wherein the handle urges the actuator element into the first actuating position, and a second position, and a means for urging the actuator element into the non-actuating position.

11. A device for interconnecting a seat to a support; comprising:

a base adapted to be connected to the support;

a seat connection bracket adapted to be interconnected to the seat;

a link element having a first end pivotably mounted to the base and a second end pivotably mounted to the seat connection bracket;

an intermediate bracket pivotably mounted to the base and to the seat connection bracket, wherein pivotable angular movement of the intermediate bracket with respect to the base translates through the link element into horizontal movement of the seat connection bracket with respect to the base; and a locking member for maintaining the intermediate bracket in one of a plurality of predetermined positions with respect to the base.

12. The device of claim 11 further comprising a seat height adjustment structure for adjusting the height of the seat with respect to the support.

13. The device of claim 12, wherein the seat height adjustment structure includes a gas piston assembly and an actuator element pivotably mounted to the base and movable between a first actuating position wherein the actuating element actuates the gas piston assembly, and a second non-actuating position.

14. The device of claim 13, wherein the actuator element is movable between its actuating and non-actuating positions in response to operation of a handle movably mounted to the base for movement between an actuating position and a non-actuating position.

15. The device of claim 14, wherein the handle is pivotably mounted to a housing secured to and extending from the enclosure, and further comprising a slider member movably mounted within the housing, wherein the slider member is movable in response to movement of the handle and is engageable with the actuator element for controlling movement of the actuator element between its actuating and non-actuating positions in response to movement of the handle between its actuating and non-actuating positions.

16. A device for interconnecting a seat to a support, comprising:

a base adapted to be connected to the support;

a seat connection bracket adapted to be interconnected to the seat;

a link element having a first end pivotably mounted to the base and a second end pivotably mounted to the seat connection bracket;

an intermediate bracket pivotably mounted to the base and to the seat connection bracket, wherein pivotable movement of the intermediate bracket with respect to the base translates through the link element into horizontal movement of the seat connection bracket with respect to the base, wherein the intermediate bracket includes a plurality of apertures, each aperture corresponding to one of a plurality of user selected positions for the intermediate bracket; and a locking member for maintaining the intermediate bracket in one of a plurality of predetermined positions with respect to the base.

17. The device of claim 16, wherein the base includes an aperture extending therethrough, wherein the base aperture is axially alignable with a user selected one of the plurality of apertures in the intermediate bracket.

18. The device of claim 17, wherein the locking member includes at least one pin, wherein the pin is positionable within the aperture in the base and the selected aperture in the intermediate bracket so as to prevent movement of the intermediate bracket with respect to the base.

19. The device of claim 18, further comprising a handle for moving the pin between a first disengaged position wherein the pin of the locking member is disengaged from the intermediate bracket and a second engaging position wherein the pin extends into the selected aperture in the intermediate bracket.

20. The device of claim 19, further comprising a biasing element disposed between the base and the intermediate bracket for biasing the seat toward a predetermined angular position.

21. In a chair control mechanism for interposition between a support member and a seat and including a housing mounted to the support member and a seat bracket mounted to the seat, a control arrangement for controlling one or more operations of the mechanism, comprising:

an actuator housing mounted to the chair control mechanism housing;

a handle movably mounted to the actuator housing for movement between an actuating position and a non-actuating position; and a slider member mounted for axial movement within the actuator housing, and including an actuator member axially movable therewith in response to movement of the handle between its actuating and non-actuating positions, wherein the actuator member functions to control one or more operations of the mechanism.

22. The control arrangement of claim 21, wherein the support includes a height adjustment mechanism, and wherein the actuator member controls operation of the height adjustment mechanism through a height adjustment actuator mounted to the housing of the mechanism.

23. The control arrangement of claim 21, wherein the mechanism includes an intermediate bracket pivotably mounted to the housing of the chair control mechanism and pivotably mounted to the seat bracket, wherein the actuator member functions to control the angular position of the intermediate bracket relative to the housing of the chair control mechanism to thereby control the angular position of the seat relative to the support.

24. The improvement of claim 21, wherein the handle and the slider member include mating cam structure for providing movement of the slider member in response to the movement of the handle between its actuating and its non-actuating positions.

25. In a chair control mechanism for interposition between a support member and a seat and including a housing mounted to the support member and a seat bracket mounted to the seat, a control arrangement for controlling one or more operations of the mechanism, comprising:

an actuator housing mounted to the chair control mechanism housing;

a handle movably mounted to the actuator housing for movement between an actuating position and a non-actuating position; and a slider member mounted for axial movement within the actuator housing, and including an actuator member axially movable therewith in response to movement of the handle between its actuating and non-actuating positions, wherein the actuator member functions to control one or more operations of the mechanism;

wherein the mechanism includes an intermediate bracket pivotably mounted to the housing of the chair control mechanism and pivotably mounted to the seat bracket, wherein the actuator member functions to control the angular position of the intermediate bracket relative to the housing of the chair control mechanism to thereby control the angular position of the seat relative to the support; and wherein the intermediate bracket includes a side wall defining one or more spaced openings, wherein the actuator member is selectively positionable within one of the openings for selectively locking the intermediate bracket in position relative to the housing of the chair control mechanism.

26. The control arrangement of claim 25, further comprising a biasing element interposed between the actuator member and the housing of the chair control mechanism for urging the actuator member toward a retracted position out of engagement with the intermediate bracket, wherein movement of the handle to its actuating position urges the actuator element into one of the openings in the intermediate bracket against the force of the biasing element.

* * * * *